US009171476B2

(12) United States Patent
White et al.

(10) Patent No.: US 9,171,476 B2
(45) Date of Patent: Oct. 27, 2015

(54) SYSTEM AND METHOD FOR AIRPORT SURFACE MANAGEMENT

(71) Applicant: PASSUR Aerospace, Inc., Stamford, CT (US)

(72) Inventors: Thomas White, Huntington, NY (US); Peter Gerlett, Long Beach, NY (US); Ron Dunsky, Brooklyn, NY (US); James Cole, East Setauket, NY (US); Robert Damis, Patchogue, NY (US)

(73) Assignee: PASSUR Aerospace, Inc., Stamford, CT (US)

( * ) Notice: Subject to any disclaimer, the term of this patent is extended or adjusted under 35 U.S.C. 154(b) by 32 days.

(21) Appl. No.: 14/047,752

(22) Filed: Oct. 7, 2013

(65) Prior Publication Data

US 2014/0039783 A1 Feb. 6, 2014

Related U.S. Application Data

(63) Continuation of application No. 13/236,248, filed on Sep. 19, 2011, now Pat. No. 8,554,457, which is a continuation-in-part of application No. 13/184,124, filed on Jul. 15, 2011.

(60) Provisional application No. 61/364,663, filed on Jul. 15, 2010, provisional application No. 61/383,803, filed on Sep. 17, 2010, provisional application No. 61/429,589, filed on Jan. 4, 2011.

(51) Int. Cl.
*G08G 5/06* (2006.01)

(52) U.S. Cl.
CPC . *G08G 5/06* (2013.01); *G08G 5/065* (2013.01)

(58) Field of Classification Search
CPC ..... G06G 7/76; G06F 19/00; G06F 7/00; G06F 17/00; G01C 21/10; G01C 23/00; G01C 21/20; G08G 1/16; G08G 5/0026; G08G 5/0021; H04M 11/00; H04Q 7/20; G06Q 10/00; G06Q 10/06; B61L 23/00
USPC ..... 701/120; 340/978; 455/404.1; 324/300; 700/213; 382/170; 342/36; 703/16
See application file for complete search history.

(56) References Cited

U.S. PATENT DOCUMENTS 6,282,487 B1 * 8/2001 Shiomi et al. ..... 701/120
6,789,011 B2 * 9/2004 Baiada et al. ..... 701/120

(Continued)

*Primary Examiner* — Tuan C. To
*Assistant Examiner* — Yuri Kan
(74) *Attorney, Agent, or Firm* — Fay Kaplun & Marcin, LLP

(57) ABSTRACT

Described herein are systems and methods for surface management of an airport. One embodiment of the disclosure of this application is related to a method including receiving airport data from an airport network, receiving surface surveillance data for specific segments of an airport area, identifying predicted conflicts within one of the segments based on the airport data and surface surveillance data, and allocating a taxi time slot for the flight. Another embodiment of the disclosure of this application is related to a system comprising a user interface displaying information related to flight plan data and airport data received from an airport network, and a surface management module receiving the airport data and surface surveillance data for specific segments of an airport area, identifying predicted conflicts within one of the segments based on the airport data and surface surveillance data, and allocating a taxi time slot for the flight.

20 Claims, 9 Drawing Sheets

(56) References Cited

U.S. PATENT DOCUMENTS

| | | | | |
|---|---|---|---|---|
| 8,134,362 | B1 * | 3/2012 | Hullender et al. | 324/300 |
| 2002/0160745 | A1 * | 10/2002 | Wang | 455/404 |
| 2005/0010460 | A1 * | 1/2005 | Mizoguchi et al. | 705/7 |
| 2005/0035898 | A1 * | 2/2005 | Shiomi et al. | 342/36 |
| 2006/0095156 | A1 * | 5/2006 | Baiada et al. | 700/213 |
| 2006/0173609 | A1 * | 8/2006 | Green | 701/120 |
| 2009/0118997 | A1 * | 5/2009 | Truitt | 701/120 |
| 2010/0017105 | A1 * | 1/2010 | Pepitone et al. | 701/120 |
| 2010/0177963 | A1 * | 7/2010 | Yokomitsu et al. | 382/170 |
| 2011/0241902 | A1 * | 10/2011 | Shavit | 340/978 |

* cited by examiner

FIG. 2
Flight Table 200
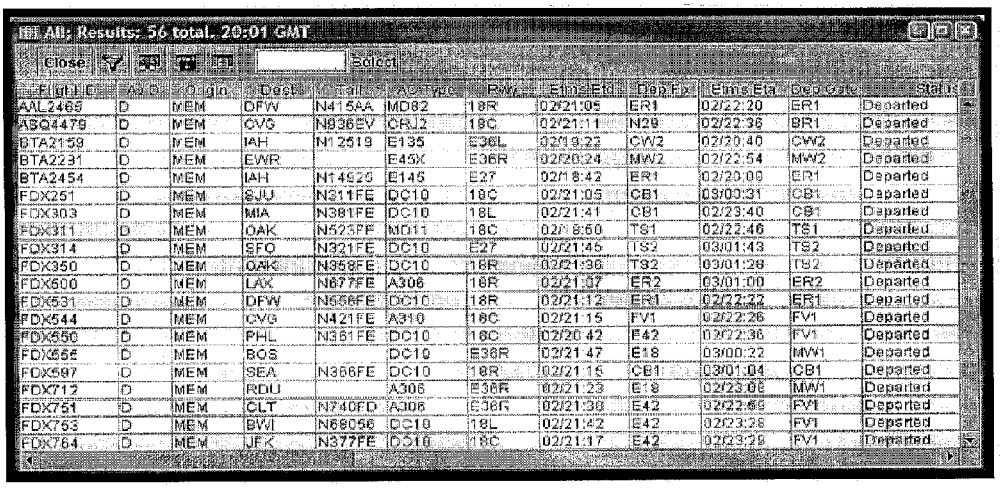
FIG. 3
Load Graphs 300
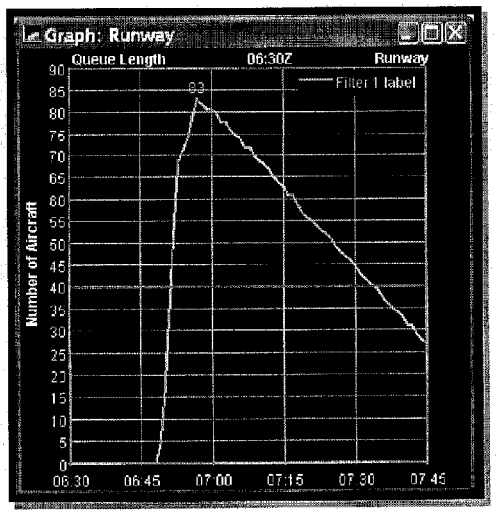
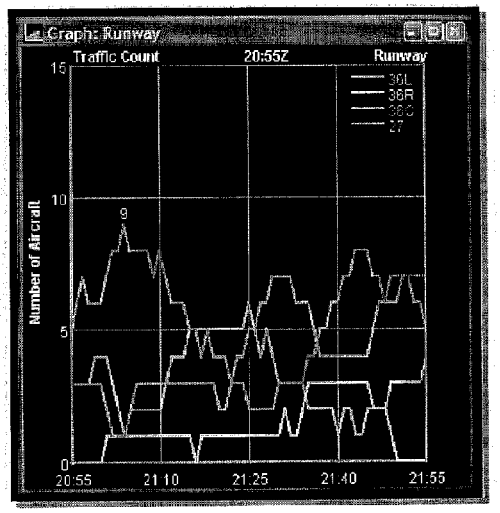

Timeline Visualization 400

Flight Table 500

Departure Slot Table 550

FIG. 6

Airline Slot Request Page 600

Legend: Unassigned | Assigned | New slot time | New taxi time | Revised ATD | Flight Cancelled

REFRESH

Arrival Schedule

| FLT | From | A/C Type | SK | TRM/ GATE | CXLD |
|---|---|---|---|---|---|
| DL169 | FOO | 767 | 135 | T3-3-B24 | |
| DL1994 | PHX | 738 | 135 | T3-3-29 | |
| DL203 | ARN | 752 | 135 | T3-3-15 | |
| DL332 | SJU | 757 | 135 | T3-3-25 | |
| DL6554 | STL | CR7 | 135 | T3-3-23 | |
| DL88 | MSP | 320 | 135 | T3-3-15 | |
| DL95 | BCN | 333 | 135 | T3-3-04 | |
| DL107 | FRA | 752 | 140 | T3-3-02 | |
| DL161 | MXP | 764 | 141 | T3-3-09 | |
| DL183 | AGP | 752 | 141 | T3-3-B20 | |
| DL72 | ATL | 767 | 141 | T3-3-B22 | |

Departure Schedule

| FLT | A/C Type | SKD | PLND TAXI | SLOT | ATD | TRM/ GATE | DST | DEP FIX/ CXLD |
|---|---|---|---|---|---|---|---|---|
| DL6332 | CR7 | 1300 | 1305 | | 1318 | T3-3-25 | CVG | RBV |
| DL3877 | CRJ | 1315 | 1320 | | 1332 | T3-3-25 | RIC | WAVEY |
| DL2545 | CR9 | 1318 | 1323 | | 1348 | T3-3-18 | DCA | |
| DL4149 | CRJ | 1330 | 1335 | | 1353 | T3-3-25 | MVY | BAYYS |
| DL4292 | CRJ | 1345 | 1415 | 1415 | | T3-3-23 | LWB | RBV |
| DL1526 | 319 | 1350 | 1355 | | 1408 | T3-3-28 | DTW | GAYEL |
| DL173 | 744 | 1355 | 1400 | 1400 | | T3-3-06 | NRT | |
| DL4025 | CRJ | 1355 | 1400 | 1400 | | T3-3-25 | IND | RBV |
| DL6430 | CR9 | 1359 | 1404 | 1400 | | T3-3-17 | BOS | MERIT |
| DL2481 | CR9 | 1400 | 1405 | | | T3-3-25 | BUF | |
| DL2301 | 752 | 1420 | 1425 | 1415 | | T3-3-03 | PIT | COATE |

Flight: | EDIT / ADD

Histogram 700

SYSTEM AND METHOD FOR AIRPORT SURFACE MANAGEMENT

PRIORITY CLAIM/INCORPORATION BY REFERENCE

The present application is a Continuation-In-Part Application of U.S. Non-Provisional patent applications Ser. No. 13/184,124 filed on Jul. 15, 2011 entitled "System and Method for Departure Sequencing at an Airport" naming Thomas White, Peter Gerlett, and Ron Dunsky as inventors. In addition, the present application claims priority to U.S. Provisional Patent Applications: 61/364,663 filed on Jul. 15, 2010 entitled "System and Method for Departure Sequencing at an Airport" naming Thomas White, Peter Gerlett, and Ron Dunsky as inventors; 61/383,803 filed on Sep. 17, 2010 entitled "System and Method for Departure Metering" naming James Cole, Robert Damis, Ron Dunsky and Thomas White as inventors; and 61/429,589 filed on Jan. 4, 2011 entitled "System and Method for Departure Metering" naming James Cole, Robert Damis, Ron Dunsky and Thomas White as inventors; and hereby incorporates, by reference, the entire subject matter of these Provisional Applications.

BACKGROUND

Currently, airlines and airport operators have little to no visibility of an airport's surface areas and airport assets. The availability of surface management information is lacking and the efficiency is departure metering suffers as a result. Airlines and airport operators need to know in advance and quickly address any chokepoints (e.g., taxiing, deicing, etc.) during the lifecycle of each flight. Furthermore, airport arrivals and departures are currently managed on a first come, first serve basis. For instance, aircraft are taxied out and get in line in order to be sequenced for takeoff. However, when runway demand exceeds an airport's capacity, the result can be long departure taxiing queues, surface congestion, gate holdouts, as well as aircraft gridlock that may result in ground stops and schedule delays while increasing the threat of Tarmac Delay Department of Transportation fines. Furthermore, these delays caused by inefficient surface management can lead to increased fuel usage, and fuel load, increased carbon dioxide emissions and diminished passenger satisfaction.

SUMMARY OF THE INVENTION

Described herein are systems and methods for surface management of an airport. One embodiment of the disclosure of this application is related to a method including receiving airport data from an airport network, receiving surface surveillance data for specific segments of an airport area, identifying predicted conflicts within one of the segments based on the airport data and surface surveillance data, and allocating a taxi time slot for the flight.

Another embodiment of the disclosure of this application is related to a system comprising a user interface displaying information related to flight plan data and airport data received from an airport network, and a surface management module receiving the airport data and surface surveillance data for specific segments of an airport area, identifying predicted conflicts within one of the segments based on the airport data and surface surveillance data, and allocating a taxi time slot for the flight.

A further embodiment of the disclosure of this application is related to a non-transitory computer readable storage medium including a set of instructions for allocating departure slots, executable by a processor. Specifically, the set of instructions to receive airport data from an airport network, receive surface surveillance data for specific segments of an airport area, identify predicted conflicts within one of the segments based on the airport data and surface surveillance data, and allocate a taxi time slot for the flight

DESCRIPTION OF THE DRAWINGS

FIG. 2 shows an exemplary flight table according to an exemplary embodiment of the present invention.

FIG. 3 shows exemplary load graphs according to an exemplary embodiment of the present invention.

FIG. 6 shows exemplary airline slot request page according to an exemplary embodiment of the present invention.

DETAILED DESCRIPTION

Figure 1:
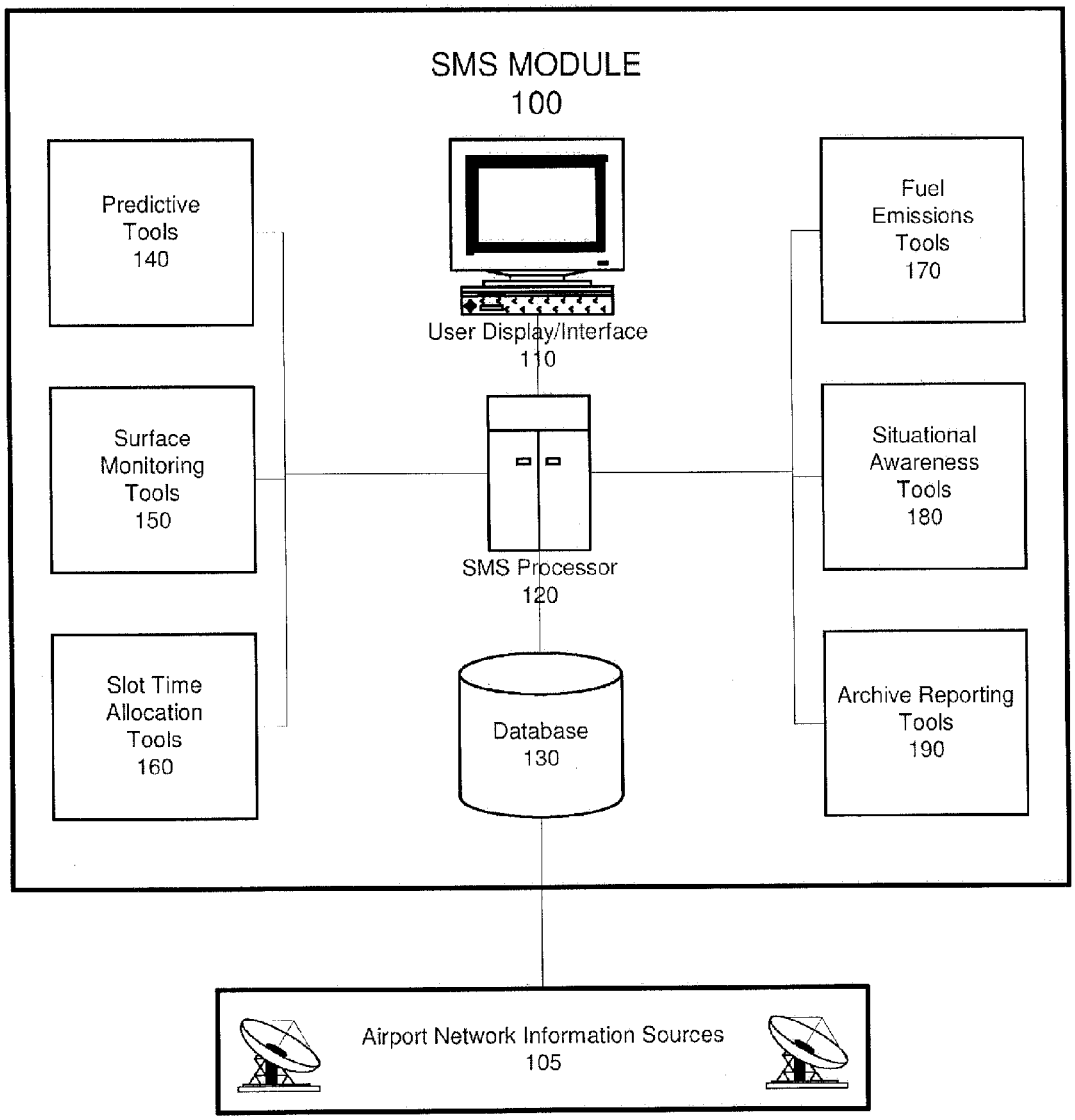
FIG. 1 shows an exemplary system for surface management of an airport according to an exemplary embodiment of the present invention.

The exemplary embodiments may be further understood with reference to the following description and the appended drawings, wherein like elements are referred to with the same reference numerals. The exemplary embodiments describe systems and methods for surface management of an airport.

As will be described in detail below, the exemplary systems and methods described herein allow an airport to maximize the use of existing capacity consistent with current and forecasted constraints on the operation of the airport. The exemplary surface management system ("SMS") may be used to manage surface operations as part of a single, seamless, integrated whole consisting of arrival, surface movement (e.g., during arrivals and departures), and departures into airspace. The workload for SMS users, such as airline and airport operators, may be reduced through the automation of several operational functions. The SMS may minimize engines-on taxi times and queue lengths while maintaining constant demand on the available runway capacity. In addition, the predictive capabilities of the SMS enhance strategic, pre-tactical and tactical decision-making to a proactive posture, rather than a reactive posture.

Furthermore, the exemplary SMS may enhance an airport's ability to manage aircraft arrivals and departures during peak operating times, bad weather, construction projects, or any other occasion where demand exceeds airport capacity. Specifically, the exemplary systems and methods may allocate departure sequencing through the use of various sources of information and resources, such as surveillance data, air traffic management software, and professional services. These exemplary systems and methods described herein may reduce airline fuel costs and $CO_2$ emissions, minimize taxi/tarmac delays, and improve the overall passenger experience.

As will be described in greater detail below, the exemplary systems and methods for airport surface management may utilize any number of software modules and data integration to achieve airspace and surface efficiencies. For instance, data integration services may provide various data sets and sources to be ingested, processed, stored and managed by the exemplary SMS. In addition, the SMS components and functionalities may be compliant with industry standards for seamless integration with other information systems and may include a redundant and fault tolerant data management infrastructure. Accordingly, the exemplary SMS may be fully compliant with all applicable regulations, codes, standards and specifications such as those imposed by the Federal Aviation Administration ("FAA"). It should be noted that fully compliant operation of the SMS components and methods may build upon pre-existing services as well as management and operational staff.

According to the exemplary embodiments of the systems and methods described herein, the SMS provides users with airspace surveillance and predictive analytics capabilities, departure metering software and management, collaborative software platforms for instant secure distribution of information as well as surface tracking display technology. Furthermore, the SMS methods and components may interact with any number of surface prediction models and tools, live surface monitoring modules, departure metering and sequencing decision support applications, and surface performance reporting and analysis components.

As will be detailed throughout the description below, the SMS methods and components allow for increased automation in typically time-consuming tasks such as airline slot and taxi time management, slot allocation, slot swaps and substitutions, and distribution of flight information (e.g., airline "ready state" data feeds, etc.). The surface management predictive analytics described herein enable efficient queue management, sequencing, allocation and surface conflict resolution. The exemplary SMS provides a single visual platform for integrated flight tracking (e.g., en route, terminal and surface) throughout each lifecycle of a flight within FAA-classed movement area, non-movement areas and airspace.

The SMS methods and components, or simply SMS module, may be a single software platform hosted on the Internet for complete access to geographically distributed users. For instance, each of the components of the SMS module may be browser-based, capable of operating on any number of browsers (e.g., FIREFOX®, INTERNET EXPLORE®, CHROME®, SAFARI®, OPERA®, etc.). Furthermore, the web-based platform of the SMS module eliminates the need for any end users to manage software installations or maintenance.

Accordingly, this single software interface for airport management may integrate visual displays of surface operations with displays of airborne data, thereby creating a comprehensive single air-to-ground management hub, capable of tracking flights from gate-to-gate, en route to terminal airspace to surface. It should be noted that the SMS module may utilize tracking information from any number of aviation data sets and air traffic monitoring sources, such as, automatic dependent surveillance-broadcast ("ADS-B") components, aircraft communications addressing and reporting system ("ACARS") components, airport surface detection equipment ("ASDE-X") components, or any other tracking technologies that are available.

FIG. 1 shows an exemplary SMS module 100 for surface management of an airport according to an exemplary embodiment. The SMS module 100 may include a user interface, such as a user display/interface 110, an SMS processor 120 and a database 130. The SMS module 100 may feature any number of various components such as predictive tools 140, surface monitoring tools 150, slot time allocation tools 160, fuel emission modeling modules 170, shared situational awareness tools 180, reporting modules 190, etc. In addition, the SMS module 100 may be in communication with any number of airport network information sources 105, such as, but not limited to flight plan information, airport facilities information, radar networks, weather data feeds and emergency information. The airport network information sources may include information from air tracking monitoring sources, as well as any data entered manually by a user.

The exemplary user display/interface 110 of the SMS module 100 may combine and process all of the flight and surface data into a comprehensive visualization portal for the user. The display 110 may incorporate a detailed base map of an airport's operation while supporting the user-controlled display of "information layers" of the airport's physical attributes, such as gates, stands, terminals, taxiways, throats, alleyways, runways, etc. Situational displays may incorporate runway configurations, aircraft and vehicle icons, fate/stand occupancy status, timeline for departures and arrivals, weather display, alerts to users, configurations of alerts, etc. Some exemplary graphical user interfaces ("GUIs") showing these features are provided herein. However, those skilled in the art will understand that these are only exemplary and there are numerous formats in which the relevant data may be displayed.

The exemplary SMS processor 120 may use predictive analytics to support effective queue management and sequencing while ensuring the lowest possible engines-on taxi times. For instance, the SMS processor 120 may determine system and airport capacity imbalances in advance, predict departure queue conditions, identify and alert arrival/departure gate conflicts, etc. Furthermore, the SMS processor 120 may provide integration of arrival operations and its effect on departure operations using system demand forecasting, individual fight arrival time predictions, and gate conflict forecasting and alerting.

The data feed for the exemplary database 130 and SMS processor may be received from multiple external data inputs. These inputs may include, but are not limited to, redundant Internet ISPs that allow the SMS module 100 to remain online in the case of a single ISP outage, FAA Aircraft Situation Display to Industry ("ASDI") data feed, inputs from numerous radar systems around the world, multiple feeds from airlines, multiple feeds from airports, FAA ASDE-X surface movement feeds, etc.

The exemplary predictive tools 140 may analyze departure times and departure delays by taxiway and runway in order to maximize the efficient use of both runway and common departure fix capacity. Accordingly, the goal of the predictive tools 140 may be to feed the overhead stream in the most efficient manner, for an overall efficiency gain in the operational area of the airport and neighboring airports.

The surface monitoring tools 150 may provide "region of interest" tracking, conflict alerts, and other user-defined live information about specific subsets of the surface operation that are of interest. Specifically, the surface monitoring tools 150 may use a predictive logic engine to forecast surface saturation and gate conflicts.

According to the exemplary embodiments, the SMS module 100 may exhibit shared situational awareness, through which all relevant information about airport operation is available on demand to all interested and authorized users. This may include both "web dashboards" of aggregated information, and visual flight tracking of the surface and airborne operations. For instance, existing airfield operations pages in which Notice-To-Airmen ("NOTAM") and non-NOTAM field status information may be maintained and distributed, integrated directly with the FAA NOTAM system. Additional web dashboards may include a diversion management portal, an airspace optimization dashboard, flight status portals, system metrics dashboards, etc.

The slot time allocation tools 160 may work in collaboration with airline operations managers, using automated assignments based on rationing principles, current and forecasted operational constraints, capacity/demand balancing (e.g., fix-load balancing), and automation to manage flight readiness and slot time swaps and substitutions for minimal airline manual inputs.

For instance, the slot time allocation tools 160 may provide automatic population of aircraft departure slots using the received flight plan information from the airport network information sources 105. Those skilled in the art would understand that each aircraft and airline files a flight plan with the FAA for each flight. The flight plan information may include a scheduled takeoff time (e.g., wheels up time), routing information, etc. Upon receiving the flight plan information for a specific aircraft, the slot time allocation tools 160 may calculate an estimated taxi time ("ETT") for that aircraft. For instance, the ETT may be based on airport information, such as gate assignments, runway usage, etc. Using the ETT calculated from the flight plan information and the airport information, the exemplary allocation tools 160 may automatically assign a departure slot for the aircraft. The assigned departure slot may be displayed to the user via the SMS display 110. Therefore, airlines and departure metering center teams may manage the initial allocations of departure slots more efficiently. Specifically, the airlines do not have to make manual requests for departure slots since the allocation tools 160 determine the initial slots based on the flight plan information and the calculated ETT. In addition, the metering center teams do not have to manually assign these initial departure slots. Thus, the only manual operation may be addressing user-generated changes by exceptions.

The fuel emission modeling modules 170 may receive data from a departure metering archive database, and enhance the data via surface operations models for fuel burn reduction through metering. The fuel emission modeling modules 170 may be built upon International Civil Aviation Organization ("ICAO") internationally accepted fuel emissions models. Accordingly, these modules 170 may provide further enhancements to the ICAO fuel emissions modeling formulas.

The reporting modules 190 may provide post-operational performance analysis of airspace, surface and field condition statistics. These statistics may be used in generating detailed reports on demand/capacity performance in the terminal airspace, as well as detailed surface performance reporting.

It should be noted that the communication between the database 130 and the various other components of the SMS module 100 may be secured communications. In other words, the information transfer to and from the database 130 may be filtered using any number of encryption methods, authentication and verification systems, security protocols, etc.

The hosting of the SMS module 100 may be provided from remote data centers, with full backup and redundancy. In addition, the SMS module 100 may build and expand upon existing geographically redundant infrastructures and backup facilities. The predictive analytics may be provided in the form of various software modules that may reside a network-operating center (e.g., data and software hosting), and in redundant data centers as well. Therefore the SMS module 100 may provide data seamlessly into the airport surface management solution and ensure that the delivery of this solution may continue to be performed onsite with the addition of new software and operational capabilities, as described above.

Predictive Analytics and Surface Monitoring/Visualization.

The predictive tools 140 described above may utilize a prediction engine ("PE") that fulfills multiple objectives to support surface management capabilities. These objectives may include predicting Out, Off, On, and In ("OOOI") events for flights, predicting the overall flow rates at the airport, on runways and on taxiways, predicting the delays that will occur in the operation, as well as supporting the automated analysis of operational alternatives in any additional decision support tools. The fundamental approach used in the PE model algorithm is to perform an internal "fast-time" simulation of the airport surface and terminal area operation, while applying the necessary decisions and constraints that controllers will have to apply in managing the traffic. This internal simulation modeling approach may be used in contrast to other methods such as historical, statistical, or regression-based approaches to predict the taxi times or OOOI event times for flights. Accordingly, the predictive tools 140 address the highly nonlinear and non-stationary nature of the airport-operating environment with greater accuracy and efficiency.

The PE may address pushback, taxi in, ramp, spot queuing and taxi clearance request, taxiing in the airport movement area, queuing at the runway for departure, required runway spacing constraints, etc. Runway spacing constraints may account for both same-runway separations for wake vortices, runway occupancy times, required separations between flights operating on dependent runways (for both arriving and departing flights), and separations required across departure fixes. The PE may also address staging and sequencing of flights to meet traffic management restrictions.

In addition, the PE may assign times to each flight at certain control points. For instance, each of the assigned times may represent the time at which the flight is expected to cross the four primary control points: gate (e.g., pushback or block-in), spot (e.g., transition from ramp to movement area or vice-versa), runway (e.g., takeoff or landing) and the arrival or departure fix. Accordingly, the PE may determine a fixed runway assignment and a fixed taxi path for each flight. The PE may utilize the current airport configuration and predicted schedule of airport configuration changes. The data may be provided via the airport network information services 105 or via the other components of the SMS module 100.

According to the exemplary embodiments of the predictive tools 140, the functions of the PE within the SMS module 100 may include, but are not limited to: providing efficient queue management and sequencing; ensuring current surface constraints are factored into the plan (e.g., the PE considers multiple constraint points in its prediction calculations); contributing to strategic, pre-tactical, and tactical flow management for both allocation of taxi times, ability to meet taxi times, and for merging into the en route stream to a common departure fix; predicting runway queues and anticipated delays for each queue; allocating taxi times that take into account current and forecasted constraints to maintain departure queue lengths to multiple runways; etc.

The surface predictions rendered by the PE may be visualized on an integrated traffic management interface on the appropriate components, such as the user display 110 of the SMS module 100. For instance, flight tables may be used to display multiple data points for all flights (actual, estimated, and predicted). An exemplary configured flight table 200 is shown in FIG. 2. As illustrated, the flight table 200 may contain a row for each displayed flight and columns for various configurable data. Furthermore, multiple flight tables may be viewable simultaneously on the user display 110. The configuration of each table may be controlled separately, so that different views and aspects of flight tables can be viewed simultaneously. Flights may be filtered to allow users to focus on flights of interest or flights according to function. For example, flights can be segmented by: not yet ready to push; ready to push but held; non-movement area; taxiing/movement area; queued for runway; etc.

In one exemplary instance, an operator user focused on departure metering at a glance may use such tables to see which flights to call next for taxi release. Similarly, an airline user may quickly see the times at which each of his flights is likely to be wheels-up, and use that information to swap or substitute positions in the virtual departure queue. Additional data may be provided such as "ETA at the destination" accounting for departure queuing, surface and all other delays. Unavailable through any other source, the "ETA at the destination" field may allow an airline user to see the implications on their destination schedules of the swap and substitution choices they make. Accordingly, this information will enable airline users to be proactive about crew legality issues and about passenger, crew, and equipment connections further down the line.

In addition, alerts may be set up via the user display 110, as well. For example, a table may be set to display all flights that are predicted to have a total surface time of more than two and a half hours. A filtering functionality may be set to select all departures assigned to a specific runway (e.g., either out or taxiing in the movement area). Departure fix delays may also be predicted and displayed in the PE output of the prediction tools 140. These delays may be incorporated into a metrics dashboards available to the user.

Further visualization may include a load graph configured to measure load at a spot, runway, departure fix, and/or gate. FIG. 3 shows exemplary load graphs 300 displaying the number of aircraft operating on each of the runways over a one-hour period. For departure metering, a load graph showing the predicted queue length over time may be useful as a quick visual to ensure that pressure is being maintained on the runway, but that queues are not likely to become too long.

Figure 4:
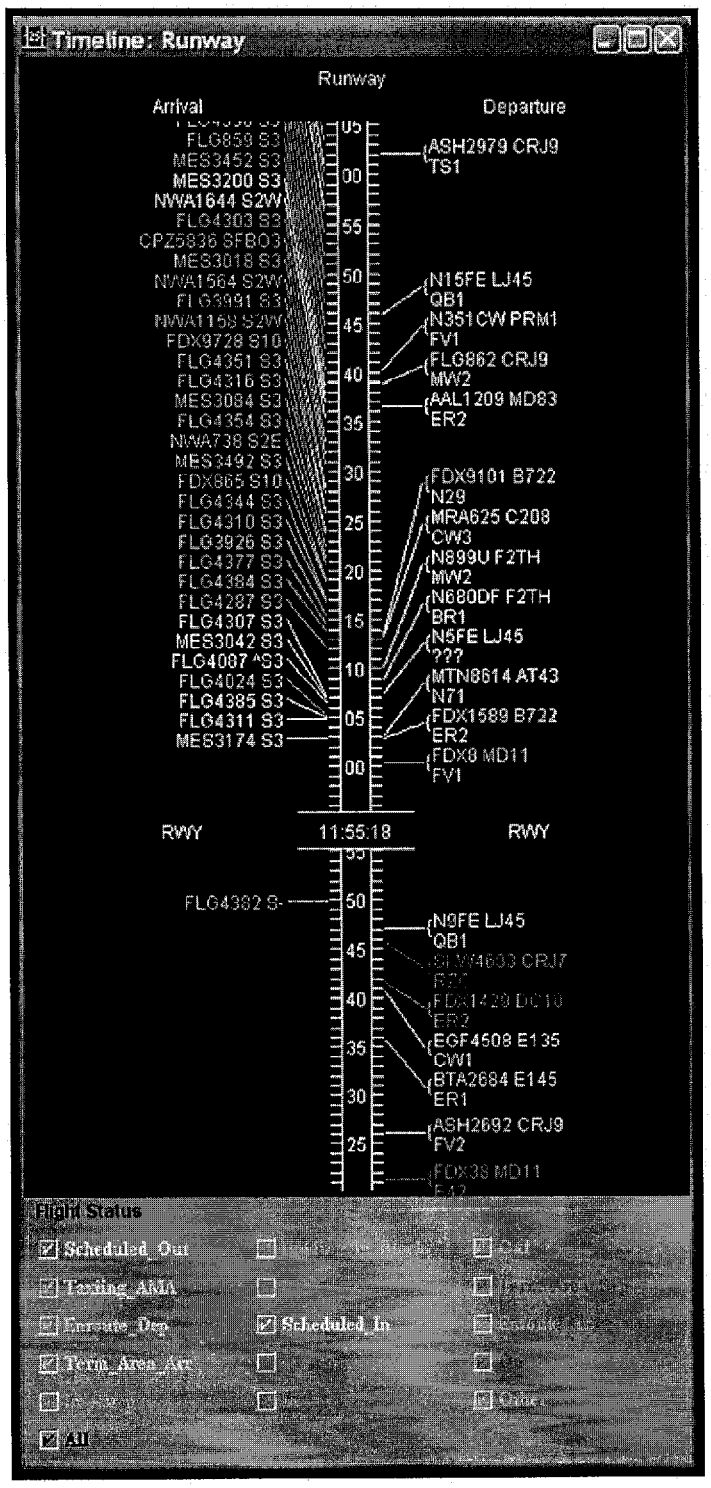
FIG. 4 shows exemplary timeline visualization according to an exemplary embodiment of the present invention.

FIG. 4 shows exemplary timeline visualization 400 according to an exemplary embodiment of the present invention. Timelines may offer another view of the traffic that is useful for understanding, at a glance, the pace of operations and the flights involved. The timeline visualization 400 may hold some of the same information displayed in flight tables 200, but the flights are depicted graphically based on their time of operation at points of interest, such as runway, gate, spot, arrival/departure fix, etc.

Figure 5A:
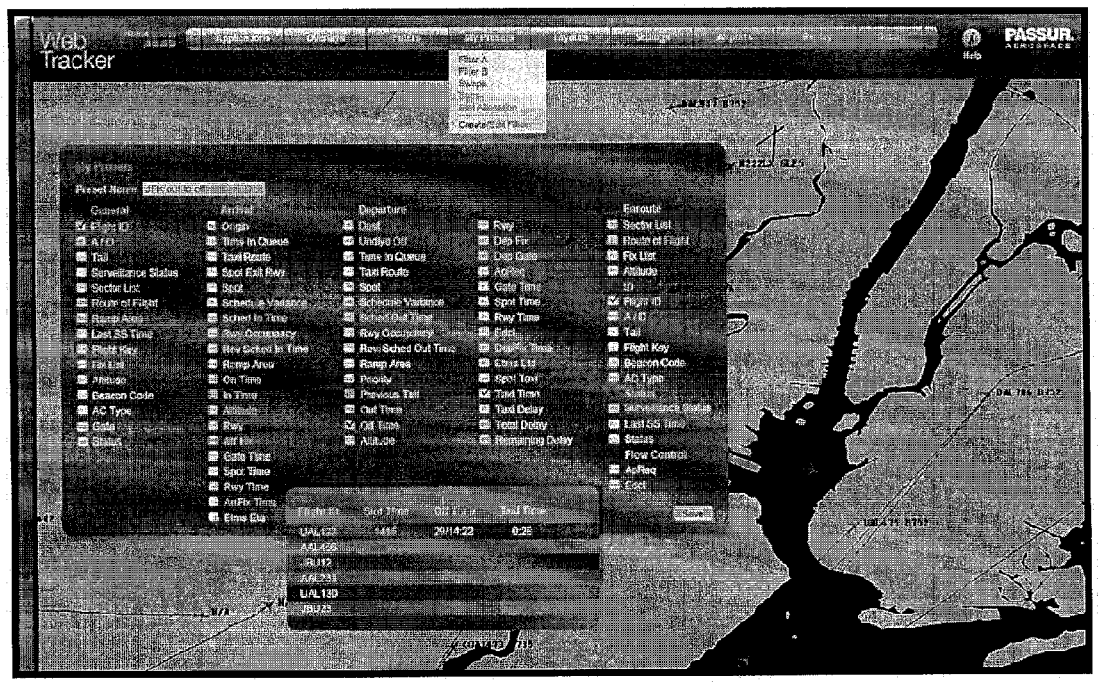
FIG. 5A shows a user-defined flight table integrated within a web tracking display according to an exemplary embodiment of the present invention.
Figure 5B:
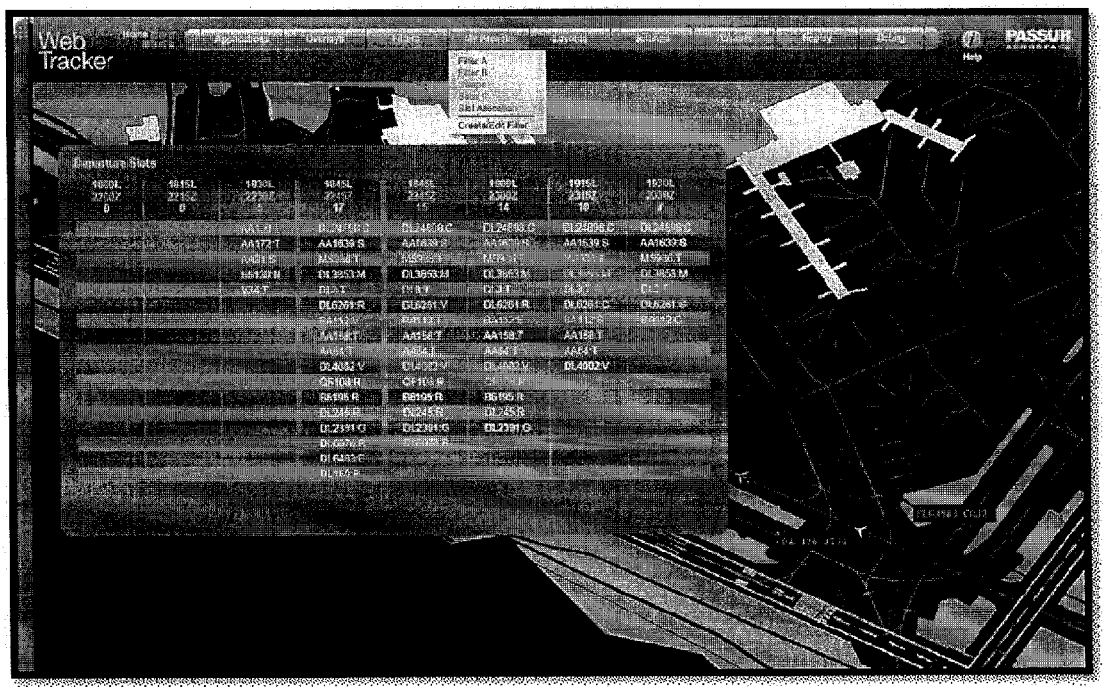
FIG. 5B shows a user-defined departure slot table integrated within web tracking display according to an exemplary embodiment of the present invention.

According to the exemplary embodiments, any of these visualizations provided by the prediction tools 140 may be integrated directly into the SMS module 100. In other words, the flight tables, load graphs, timelines, etc. may be integrated into the web-based tracking display to provide the user with en route, terminal and surface surveillance within a single interface. FIG. 5A shows a user-defined flight table integrated within a web tracking display 500. According to this example, the user may select any number of variables to display on a customized table. In this case, the user has selected and is provided with the slot time, off time, and taxi time based on the Flight ID. FIG. 5B shows a user-defined departure slot table integrated within web tracking display 550.

Additional performance prediction engines of the prediction tools 140 may include an air traffic control ("ATC") portal. An exemplary ATC portal may provide an outlook ahead into performance of specific terminal airspaces to predict and alert to potential imbalances between demand and capacity. An exemplary ATC portal is described in, U.S. Pat. No. 7,778,768 issued on Aug. 17, 2010 entitled Reducing Airport Delays Using Passive radar Information and Analytics, which is expressly incorporated by reference.

The ATC portal may use a terminal area forecast ("TAF") engine to generate predicted performance of key metrics, based on both past performance under identical conditions and user-defined triggers and scenarios to create alerts and performance scores for an accurate forecast of performance. Various metrics tracked by the ATC portal may include, but are not limited to, arrival rate and departure rate, runway configuration, holding (e.g., number and specific identity of aircraft holding), arrival efficiency score based on assessment of required wake turbulence spacing, weather, current ground delay programs, etc.

Accordingly, the ATC portal may be used in conjunction with several functionalities of the SMS module 100. For instance, the ATC portal may set correct rates for departure-metering program (e.g., in taxi-time/slot time allocation calculator) based on predicted arrival and departure volumes, runway configurations, and constraints (e.g., Traffic Management Initiatives). Taxi-time allocations are typically done two hours in advance, per established operational protocols, but can be extended several hours in advance based on the ATC portal predictive window. The ATC portal may further allow users of the SMS module 100 to accurately forecast true performance of the airport based on TAF and planned Ground Delay Programs, independent of any actual ATC published rate. The ATC portal ensures that the SMS module 100 takes into account forecasted FAA, airfield, capacity, and weather restrictions, as well as ensuring the SMS module 100 properly calibrates performance plans based on actual performance capabilities under identical conditions forecasted. The ATC portal ensures that departure queue lengths are maintained at ideally calibrated volumes by helping the SMS operator to allow an appropriate level of demand onto the movement area.

A further performance prediction engine of the prediction tools 140 may include an estimated time of arrival ("ETA") portal. The ETA portal may be derived from algorithms received by multiple data sources in real time, including flight position information from the network of radar systems. The ETAs may be calculated by tracking multiple real-time measurements of the target flight, as well as other nearby aircraft in the surrounding airspace, along with current and historic/archived airspace conditions. An exemplary ETA portal is described in, U.S. Pat. No. 8,140,199 issued on Mar. 20, 2012 entitled System and Method for Predicting Aircraft Gate Arrival Times, which is expressly incorporated by reference.

For instance, passive radar surveillance tracks may be updated on a short periodic basis (e.g., every 4.6 seconds), which provides the detail and precision of aircraft position and movement required to create predictive accuracy that is built on tracking the behavior of multiple aircraft simultaneously in real time, as well as the comparison of current conditions to identical conditions stored in an archive. The extensive historical data in the archive may be an additional component for providing operational pattern recognition to enable past performance to predict future performance. The depth and breadth (e.g., detail and number of years) of the historical archive provides the sample size required for this predictive capability to be effective. The tracking may also include beacon code and tail number acquisition and correlation. An exemplary flight-tracking module may operate independently of ASDI data stream (e.g., the FAA flight plan, en route radar feeds). This allows tracking to continue even if/when the ASDI feed fails.

Certain unique capabilities of the exemplary ETA portal include, but are not limited to, automatic adjustments for dynamically changing ATC conditions, such as holding, runway changes, vectors (e.g., S-turns), extended downwind legs, speed of preceding aircraft (taking into account wind and TMI restrictions such as miles-in-trail or sequencing on final), and extensive historical archiving, which enables more accurate predictive capabilities, including dynamic adjustments for TMIs and On-to-In predictions. By combining of the entire radar surveillance network into a single national and transnational (e.g., U.S./Canada/Caribbean) coverage area, the ETA portal algorithm may be extended to gate-to-gate coverage for a much earlier and accurate prediction of arrival time. With the addition of the surface prediction capabilities of the SMS module 100, the ETA portal may be advanced to pre-departure (e.g., pre-push), giving airport operator users an unusually long lead-time in accurate arrival prediction for a departing flight's next destination, while factoring in current surface constraint as well as metering slot times.

Accordingly, when used in conjunction with the SMS module 100, the ETA portal may ensure that the management, sequencing, and allocation of departures are performed in the context of the arrival operation demand. The ETA portal may also be used on a flight-specific basis for gate management (e.g., meter at gate or to remote pad, depending on status of arrival flight) and gate conflict alerting.

FIG. 6 shows exemplary airline slot request page 600 based on the visualization of the ETA portal's output. By inputting data into the slot request page 600, airline users of the SMS module 100 may manage their departure taxi time requests. The outputted assignment also includes the ETA for each of the user's flight arrival times. Other ETA visualization locations may include, data tags in flight tracking application (e.g., surface and airborne), flight tables generated by PE integrated into the SMS module 100, flights listed on a system metrics (e.g., Key Performance Indicators ("KPI") dashboard, etc.

Taxi Time Allocations.

The slot time allocation tools 160 of the SMS module 100 allocate taxi times in order to maximize the use of capacity consistent with keeping active "engines on" taxi queues as short as possible. The slot time allocation tools 160 include a slot calculator for automatically calculating the number of departure slots available to each airport flight operator. These calculations may be based on "ration by schedule" calculations, based on the rate in which the SMS module operator enters into the calculator. The predictive engine and the ATC portal discussed above may provide an accurate forecasted departure rate. Ration by schedule means that each flight operator is allocated a fixed number of slots based on the airport schedule. For instance, Airline XYZ is allocated 30% of the slots based on the number of departures in the airport's schedule. If there is a forecasted departure rate of 40 slots per hour, Airline XYZ may receive 12 of the slots for that hour.

The slot time allocation tools 160 may also provide automatic population of taxi times. For instance, once a rate is entered into the slot calculator for an airport, all flights scheduled for departure at that airport over a set timeframe (e.g., eight hours) are automatically re-allocated based on the new departure rate and the ration by schedule allocation. After initial allocation, each individual flight operator may access its schedule to request adjustments in departure slot times. For instance, the SMS module 100 may receive adjustments via a slot display interface, on a flight-by-flight basis, and allow for multiple requests and changes. Once allocation change requests have been processed by the SMS module 100 on the slot management module, changes may be alerted on the flight operator screen and may require acknowledgement over the interface.

After initial auto-allocation and/or after operator request for new times, the SMS module 100 may display all of the allocation requests and change allocation assignments. Change requests may be color-coded to alert SMS module 100 users of actions they need to take. Allocation management is executed online through a variety of functions on the slot manager that allows the SMS users to efficiently and quickly allocate flights individually or in bulk. Different color codes alert the SMS users to different status levels of the allocation request or assignment, along with moving timelines to indicate potential problems in flights not achieving their planned taxi times. The inclusion of "first fix" information on the departure manager for each flight, combined with the other information sets available through the SMS module 100 about each flight (e.g., planned taxiway and runway, predicted times as described above for key milestones on the surface, current runway configuration, and departure/arrival demand and capacity, etc.), allow the SMS user to make taxi time assignments that consider "fix load balancing" in order to maximize the use of taxiway, runway, and departure fix capacity.

Accordingly, the slot time allocation tools 160 of the SMS module 100 provide allocation of taxi times, departure management for merging into an en route stream or common departure fix from multiple runway configurations, and pre-tactical, and tactical aircraft sequencing, scheduling and runway allocations to meet airport arrival and departure operating constraints. The enhancements provided by the slot time allocation tools 160 ensure greater automation and less workload demand on SMS operators and end users, especially flight operators.

One enhancement is the flight "ready state" feed. The flight "ready state" feed generates automated messages from airline flight management systems indicating key milestones in a flight pre-pushback, integrated with the departure slot allocation module, to automatically indicate whether a given flight will be ready for its assigned departure time or needs a new assignment. Milestones in a flight might include, for example, first/last passenger boarding pass scanned, passenger door closed, cargo door closed, etc. Accordingly, this may relieve airline operators from the need to update the slot request page manually.

Another enhancement is allowing for automated "flight swap" in allocation manager screen of the SMS module 100. For instance, if the SMS user reassigns a flight to a new taxi time, the system will automatically recalculate the needed changes in all other taxi time allocations, based on the current departure demand present in the allocation module and the "ration by schedule" formula.

A further enhancement is allowing for automated substitution modeling. For instance, flight operators may be able to model scenarios in which different flight taxi times are moved or changed onscreen. Accordingly, the effects of those moves on all other flights scheduled being allocated that day may then be displayed. This enhancement may help flight operators project sequencing plans prior to an initial slot request or a subsequent to a slot change request.

Fuel and Emissions Impact Modeling.

The fuel emission modeling modules 170 of the SMS module 100 may be built upon definitive studies of fuel burn reductions generated by departure metering programs. Calculations performed by the fuel emission modeling modules 170 may include the analysis of taxi fuel burn rate for each flight given engine types (e.g., fleet database to match to airframe/engine and ground fuel flow certification data for correct engine), auxiliary power unit ("APU"), and single-engine taxi assumptions. The modeling modules 170 may determine fuel burn savings of metering by multiplying active taxi time savings for flights by the appropriate fuel flow rate. Furthermore, the modeling module 170 may convert fuel burn savings to emissions savings using CO2, HC, CO, NOx and smoke emissions indices (e.g., mass emission per mass of pollutant) in order to output a sum savings over all flights.

According to the exemplary embodiments of the modeling modules 170, the data used for the emissions model calculations may be automatically transmitted by the SMS module 100 in the form of archived taxi times and metered slot acceptance times. The enhancement provided by the modeling modules 170 include integration with an archive engine to allow users to generate fuel and emissions impact reports, measuring impacts in terms of pollutants and financial savings of reduced fuel burn (e.g., user-defined financial assumptions). Furthermore, any new or revised emission standards may be easily incorporated into the modeling modules 170. For instance, if the ICAO standard emissions models is adjusted to account for multiple added operational factors that are important to fuel burn in addition to basic active taxi time, these new models may be seamlessly incorporated into the emissions modeling modules 170 of the SMS module 100.

Surface Saturation and Gate Conflict Forecasting and Alerting.

The surface monitoring tools 150 of the SMS module 100 may use a predictive logic (similar to the PE described above) to forecast surface saturation and gate conflicts. This logic may be general and flexible enough to predict saturation, congestion, and conflicts at any part of the surface of the airport. The surface monitoring tools 150 may utilize information such as the forecast locations of aircraft and the aircraft holding capacity of any point of interest on the surface (e.g., gates, etc.). The forecast locations may be produced by the PE as its main function, while the aircraft holding capacity may be available from the airport adaptation.

The surface monitoring tools 150 monitors current aircraft locations and predicts future locations using the fast-time simulation approach discussed above. By using this information, the surface saturation and gate conflict forecasting logic may analyze every part of the airport for which the adaptation contains an aircraft-holding capacity value. For instance, capacities may be set for gates, surface bottleneck areas such as alleyway entrances, and holding pad (e.g., deicing pads, etc.) areas as well. Those areas where the forecast number of aircraft in the area approaches within the alerting threshold of the capacity may generate an alert. The surface map may have the capability to color-code the surface based on the forecast saturation level (e.g., yellow for moderate saturation, orange for high saturation, red for critical saturation, etc.).

Furthermore, gate conflict alerts may be generated by the same mechanism. Specifically, gates may be represented simply as geographic areas in the adaptation that have unit capacity. Any time that two aircraft are scheduled and/or predicted to occupy the same gate, that event exceeds the capacity and a gate alert may be generated.

Shared Situational Awareness.

The exemplary shared situational awareness tools 180 of the SMS module 100 may ensure that information is made available to all authorized users (e.g., stakeholders) in a timely fashion, regardless of their geographical distribution. Various elements of the situational awareness tools 180 may include real-time integrated air-to-surface flight tracking, system metrics, field condition reporting, eNOTAM integration with flight services, diversion management, airspace optimization, etc.

The real-time integrated air-to-surface flight tracking of the awareness tools 180 may provide a single web interface enabling the user to move from surface, to terminal airspace, to en route flight tracking within a single screen. In addition, this single screen may include detailed surface surveillance in the movement and non-movement areas. Non-movement tracking may be dependent on an amalgamation of airport network information sources 105 such as an airport's ASDE-X feed, ADS-B transmissions, and ARINC "weight on wheels" aircraft position updates on the surface.

Exemplary surface tracking information may include: airport adaptation data to ensure a visually accurate representation of the airport surface operation; detailed operationally relevant elements of the surface operation, including taxiways, runways, ramps, gates and stands, buildings, etc.; surface tracking includes integration of several key Mosaic SMS capabilities such as map adaptation technology to ensure the most relevant surface map is represented supporting 2D spatial representation and manipulation of the surface map; etc.

Exemplary airborne tracking information may include: holding; spacing between aircraft; aircraft vectoring; flow through fixes; aircraft sequencing; length of final; etc. Additional airborne and surface tracking capabilities may include: weather overlays; multi-speed replays; multiple user-defined filters and preferences, and user-defined set preference setups names and stored by user for future use (e.g., "layouts"); information layers turned on/off by user (e.g., fixes, runways, roads, etc.); aircraft icons with multiple user configurable information sets; alerts to user (audio and/or visual) in the farm of alarms to indicate movement in airborne or surface areas defined by the user (e.g., color-coded); display of all gates and stands; etc. The integrated of the awareness tools 180 with web-based flight tracking tool will also integrate a variety of real-time surface analysis tools, such as, but not limited to, timelines representing each arrival and departure; tabular display data; "region of interest" monitoring, wherein user-defined areas allow for specific focus on, and measurement of performance in, specifically defined regions of the surface operation; etc.

The system metrics module of the awareness tools 180 may be designed to optimize departure decisions to ensure an unimpeded path from pushback to wheels up. Specifically, the core of the system metrics module may be the departure sequencing KPI/decision support dashboards.

The system metrics may provide ground status information, such as, out-to-off data that indicates increasing and/or decreasing congestion for an airport, by departure runway. The out-to-off calculation may be the average aircraft taxi out to takeoff time, presented by departure runway. Ground status may also include on-to-in that indicates increasing and/or decreasing congestion for an airport by arrival runway. The on-to-in calculation may be the average taxi-in to gateon time. The ground status may further include departure queue by fix, or current average wait times and total queue length by departure fix.

The system metrics may also provide airport performance information, such as delay minutes, arrival rates, departure rates, runway configurations, etc. The delay minutes data may indicate increasing and decreasing congestion for an airport. The delay calculation may be the maximum aircraft taxi out to takeoff time, including aircraft out but not yet off, for an airport. The arrival rates data may indicate increasing and decreasing arrival counts for an airport. The arrivals/hr. calculation may be the number of aircraft landings per hour (e.g., rolling 15-minute segments) for an airport. The departure rates, or departures/hr. rate, may indicate increasing and decreasing departures counts for an airport. The Departures/Hr. calculation may be the number of aircraft takeoffs per hour (e.g., rolling 15-minute segments) for an airport.

The system metrics may further provide terminal airspace performance and terminal holds information. The terminal airspace performance information may include an airport efficiency score (e.g., aggregate arrival runway efficiency), arrival efficiency by runway indicating a differential measurement between required spacing (e.g., wake turbulence, FAA 7110.65s) versus actual spacing, and departure efficiency by runway (e.g., based on frequency of departures). The terminal area holds information may include holding stacks by fix, with number of aircraft in stack, average time in stack.

The field condition report ("FCR") of the awareness tools 180 may provide standard airport operational content areas, through a combination of menu-driven and "free form" text areas. Vital airport information, both airfield and terminal, may be posted instantly and communicated through automatic electronic communications, (e.g., e-mail, texts, etc.) to airport users. The exemplary FCR may be viewable by airport users on the secure web-based platform of the SMS module 100. Detailed information from the FCR may include runway conditions and status, taxiways, tenant advisories, construction, general remarks, and planning information. Furthermore, The FCR may be integrated seamlessly with the FAA Flight Services eNOTAM system, allowing for a single-source point of entry for all airfield conditions.

The eNOTAM Integration with flight services of the awareness tools 180 may provide seamless integration into the FAA eNOTAM system. The airport operation users may be given specific NOTAM-access permission in order to create NOTAMs. These users may be automatically identified as authorized NOTAM submitters by the FAA system. NOTAMs may be entered free form into designated NOTAM content areas, which follow standard FAA NOTAM conventions. NOTAMs may be entered as "until further notice," "with effect from/to (e.g., future)", and "until (auto-canceling)." Both submitted NOTAMs and published NOTAMs are auto-tracked on a page from the FCR. Furthermore, NOTAM updates may trigger an e-mail and/or text to a list of users managed by the airport operator.

The diversion management portal of the awareness tools 180 may enables tracking and information related to aircraft holding anywhere in the National Airspace System ("NAS") from a single screen. The diversion management portal may track diversions related to airports selected by the user. Accordingly, the top-level tracking of this portal may provides audio-visual alerts for any holding tracked by the user-specified filters, with the following information: airport code connected to the holding stack; time of earliest hold connected to that airport; current number of holding stacks; total aircraft holding in stack(s); total specific airline flights holding in stack(s); etc. Each of these options may be selectable through user-defined filter.

In addition, the user may select any one of the airports displayed to "drill down" for further information about the specific holding stacks. For instance, the following additional information may be displayed: airborne fix (e.g., by name) where each holding stack is located; aircraft ID in each stack by fix (e.g., airline/flight number); altitude of each flight in stack; time each flight entered hold; amount of time each flight has been in hold; expected (estimated) duration of flight in hold; estimated On time for each flight in hold (e.g., calculated when two or more aircraft have departed the fix); etc.

The diversion management portal may further provide tracking of status of alternates, including the following information: identification of original (or planned) arrival airport; identification of alternates associated with each planned arrival airport; total diversions currently on the ground at each alternate airport; average ground time for each diversion at each alternate airport; average on-to-in time currently at each alternate airport; fuel on board ("FOB"), as provided by airline feed; and identification of flights heading toward the hold stack. Information of the flight heading toward the hold stack may include, flight ID, estimated time to airborne fix where holding stack is occurring, tracking of diversions in progress (e.g., real time), original destination airport, original scheduled time of arrival, airport diverting to, estimated time of arrival to diversion airport, etc.

The airspace optimization portal of the awareness tools 180 may provide the current operating characteristics (e.g., profile) of an airport in 15-minute increments using the key performance metrics described above. The airspace optimization portal may generate alerts to under-performance and performance scores based on user-defined triggers and scenarios, and enables the identification of the specific metric(s) contributing to the performance imbalance. Accordingly, the airspace optimization portal may server as the real-time component of the ATC portal module discussed above in "Predictive Analytics."

Post-operational Metrics and Archives Reporting.

The reporting modules 190 of the SMS module 100 may provide the SMS users with have access to an archive reporting engine and interfaces. This archive reporting engine may have access to traffic reporting, surface reporting and performance analysis tools. The reporting interface of the reporting module 190 may be web-based, user-configurable reporting system that allows the user to generate multiple reports based on the variety of data sets being collected by the SMS module 100 specifically, and by any other modules. The reports provided by the reporting module 190 may include, but are not limited to, planned taxi vs. slot time, departure cancellations, planned taxi vs. wheels up time, slot time vs. wheels up time, non-compliant early, non-compliant late, non-compliant unlisted, chat history, NOTAMs by number, NOTAMs by date/status/type, arrivals/departures by runway, time, gate and delay factor, runway utilization reports, gate utilization reports, delay reports.

Additionally, airport performance reports may be provided such as arrival/departure rates, arrival efficiency score, holding, runway configuration, weather, etc. These reports may be relational (e.g., snapshot in time showing status of each of the above variables, to show relative status of key metrics and change over time) and also display user-defined performance alerts to imbalances in demand and capacity.

The reporting modules 190 may supports automatic generation of pre-defined standard reports as well as custom generation of new reports through a sophisticated, geographic-aware query engine. Specifically, the reporting modules 190 may extract key information from surveillance data, identifying when aircraft enter queues, cross defined geographic locations, use taxiway and runway segments, etc. Since the reporting modules 190 may interpret the data, the modules 190 are able to support queries and analyses on the information that matters to airport and airline managers. These matter may include the time spent in queue, the length of taxi, the taxi paths used, queue lengths, operations counts, usage of different resources such as fixes, gates, spots, taxiway elements and runways, etc. The modules 190 may present the information in a wide variety of formats, including textual output, histograms, time plots, geographic plots, etc.

Figure 7:
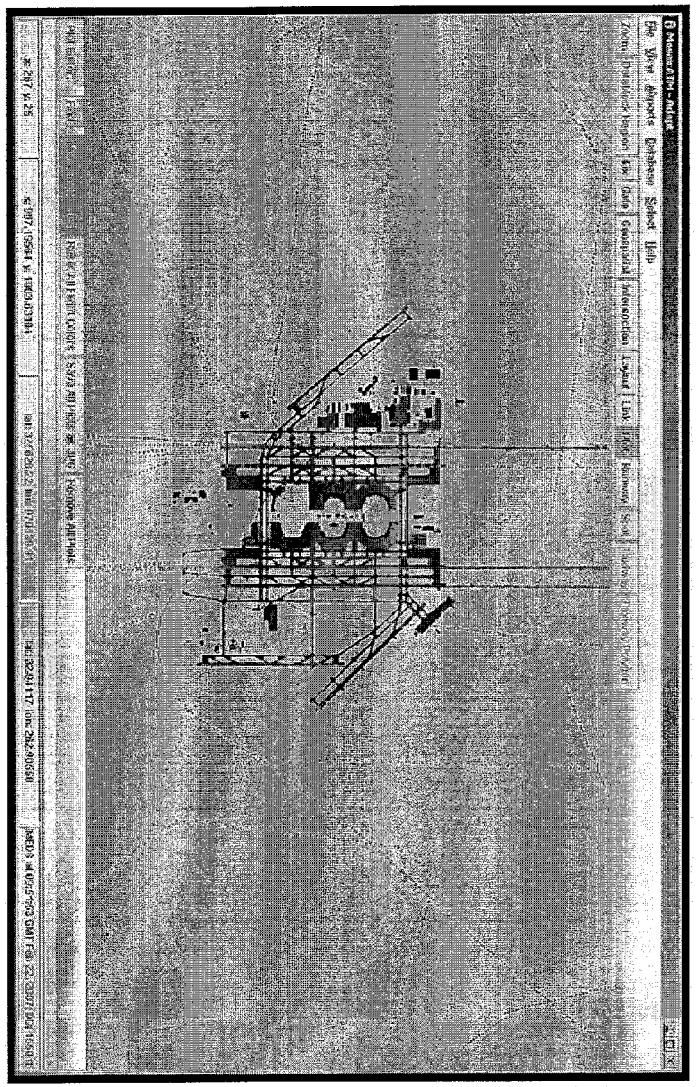
FIG. 7 shows a histogram of the time flights have spent in departure queues according to an exemplary embodiment of the present invention.

For instance, FIG. 7 shows a histogram 700 of the time each flight spent in departure queues. Presented this way, the data tells a more complete story than providing mere averages and similar statistics. The reporting modules 190 may incorporate sophisticated capabilities to select the data on which to produce reports. Therefore, it is a simple matter to start from a standard report and then drill down into outliers or other characteristics of the report to understand the detail driving the statistics.

The reporting modules 190 allow the user to analyze and troubleshoot sources of errors in departure time predictions. The exemplary SMS module 100 may avoid biases induced by its reliance on scheduled departure times through use of additional airline data obtained through airport network information sources 105.

Within the exemplary SMS module 100, the reporting modules 190 may be configured to generate the reports automatically, supplementing other existing SMS reports. Accordingly, these reports can be automatically e-mailed to stakeholders or accessed through the user display 110. Example reports may include, but are not limited to, arrival and departure summary, movement area taxi time, total taxi time, gate utilization, departure delay, arrival delay, runway utilization, metering area usage, etc. The reporting modules 190 may contain any number of ways to build custom queries, which can be used to view relationships not anticipated by pre-formatted reports.

System and Data Security.

The SMS module 100 and its components may be protected by multiple layers of data security including firewalls, access lists, and network segmentation rules. The system security may be available for auditing by the FAA, including intrusion testing, in order to ensure all systems are protected from outside threats. System logs and reporting may also monitored for any unauthorized system activity.

In addition, the application servers that receive external data from the FAA and various radars may be duplicated to provide for immediate switchover should a hardware failure occur. All database servers may be set up with "hot standby" redundancy. Furthermore, application/web servers may also redundant allowing the end user to log into several web servers in case of failure. Since the SMS module 100 may be a browser-based application sent via secure HTTPS protocol, no software is needed to be loaded to maintain data security. This includes a geographically diverse server hosted at an airport location, which also may operate as a backup server in the event that connectivity to the data and a software hosting center is dropped. Backup to the geographically redundant airport application server, including application databases, may be accomplished with an automatic hot-standby rollover.

As described above, the SMS module 100 may be powered by numerous external data sources such as FAA ASDI, radar data, MODE S data, airport ASDE-X, airline OOOI feeds, ADS-B and other aviation related databases to enable a user interface rich with relevant information. The system architecture of the SMS module 100 is capable of manually switching to secondary servers with a by simply changing web site addresses. This uses the current redundant system installed at a geographically distinct location, which may be dedicated to an airport's applications. Each of the components may be monitored and notifications are sent to administrators in the event of an outage. In addition, switching back from secondary to primary may be performed without a loss of data. In addition, any failures occurring in the primary application server may cause the system to automatically switch over without need for operator intervention. According to one embodiment of the SMS module 100, the system may detect an error and switch to a backup server. The diversely located redundant system incorporated within of the SMS module 100 allows for a disaster recovery site ("DRS") to provide data feeds from multiple locations.

The exemplary user interface of the exemplary SMS module 100 and its various components may be easily implemented in existing systems to further incorporate the above described advantages for real-time information gathering and alerting of passengers/airport personnel as well as providing back data of alerts to prepare for future anticipated alerts.

Those skilled in the art will understand that the above-described exemplary embodiments may be implemented in any number of manners, including as a separate software module, as a combination of hardware and software, etc. For example, the exemplary SMS module 100 may be a program containing lines of code that, when compiled, may be executed on a processor. Specifically, the SMS module may be a program of a server for a network in which data relating to airport surface management is stored in a database of the network.

According to a further feature of the exemplary embodiments, the SMS module 100 may quickly provide the user with taxi times of aircraft using the user display/interface 110. Specifically, the SMS module 100 may include an auto-reveal feature that displays a specific taxi time when the user "mouses over" or "hovers" a mouse pointer over a specific aircraft listed on the user display/interface 110.

For example, the user may use a mouse pointer to scroll over an aircraft in a departure slot in the display 110, and the scroll over may automatically display the planned taxi time for the aircraft in a pop-up window on the display 110. Accordingly, this feature allows for instant visibility of planned taxi times, which is a primary consideration in the reallocation of slot times. Thus, the user is provided with a much quicker and more efficient system for the reallocation of departure slots when operational considerations require changes in previous slot allocations. In addition, instant access to both planned taxi time and slot time on the same display 110 allows the user to make quick reassessments of current delays.

According to a further feature of the exemplary embodiments, the SMS module 100 may provide automatic alerts to the user when an allocated time slot for an aircraft has been changed or canceled. Specifically, the user display/interface 110 may display an automated alert to an airline, a departure metering center team, etc. The alert may be in the form of a pop-up window or new page on the user display/interface 110. Regardless of whichever screen or page the user is browsing in the display 110, the alert may interrupt the browsing and direct the user as to how to easily find new information related to the alert.

Furthermore, the alert may provide online acknowledgement to the slot allocators, thereby allow the allocators to confirm that the change has been noted by the user. Ordinarily, such adjustments to slot times and acknowledgements would require a lengthy verbal communication. However, the exemplary alert feature of the SMS module 100 allows for changes to slot times and user acknowledgement of changes to be accomplished quickly and within the screen of the user display/interface 110.

According to a further feature of the exemplary embodiments, the SMS module 100 may provide additional automated departure slot allocation. Specifically, the SMS processor 120 of the exemplary SMS module 100 may utilize a slot time calculator of the slot time allocation tools 160 to perform automatic slot allocation. For instance, the slot time calculator may receive a departure rate as an input and generate proportional allocations of slot times. Using the departure rate in conjunction with proportional allocations, the slot time calculator may automatically populate slot allocations for a pre-determined time frame (e.g., the next two hours) into a "departure slot allocation manager" page on the user display/interface 110.

According to one example, a departure capacity may be reduced due to an airport condition (e.g., severe weather) for the next two hours. Based on the reduced departure rate, the slot time calculator may proportionally reduce the slots times during the time period. For instance, if the departure rate is reduced in half, the slot time calculator may automatically reduce the departure slots in half during the time frame and repopulate an allocation grid accordingly (e.g., if an airline had 14 scheduled departure slots and the departure rate was reduced by 50%, the airline would be allocated only 7 departure slots based on the reduced departure rate). Furthermore, the slot time calculator may automatically roll-over the remaining flights into future time slots. It should be noted that other non-proportional methods may also be used to adjust the departure slot times.

As described above, the slot time calculator may use the flight plan information to determine initial allocations of departure slot times. The calculator may then use manual data (e.g., user-generated exceptions) and/or other changes to reallocate departure slot times during operation. This may effectively transform the initial slot allocation into a single-entry, one-stop process. As opposed to manually selecting flights from each airline, or pool of airlines, to meet their allocation requirements, the exemplary SMS module 100 eliminates this labor-intensive process while reducing the probability of misallocations.

According to a further feature of the exemplary embodiments, the SMS module 100 may include automated integration of planned taxi time into appropriate areas on other airport systems and networks, such as an irregular operations application (e.g., PASSUR OPSnet provided by PASSUR Aerospace, Inc. of Stamford, Conn.). Specifically, flight information from the slot allocation grid 105 as well as first departure fix for to individual flights may be provided to these airport systems and networks.

While in communication with the SMS module 100, the exemplary airport network information sources 105 may provide data tracking systems, such as an arrival management system and an air traffic management system. An exemplary arrival management system (or ETA System) may include algorithms for providing accurate arrival predictions, and thus ensuring timely and accurate reporting of detailed aircraft information to entities such as governmental agencies for deployment of interdiction teams. An exemplary air traffic management system may track flights and monitor airspace conditions, as well as provide live airspace surveillance of visual flight rules ("VFR") and instrument flight rules ("IFR"). Those skilled in the art will understand that VFR are a set of regulations which allow a pilot to operate an aircraft in weather conditions generally clear enough to allow the pilot to see where the aircraft is going, and that IFR are regulations and procedures for flying aircraft by referring only to the aircraft instrument panel for navigation.

The airport network information sources 105 may monitor flight patterns while tracking VFR and IFR of an aircraft and determine the status of a flight in real-time. As noted above, the various systems of the airport network information sources 105 may receive and correlate tracking information from aviation data sets and air traffic monitoring sources, such as, ADS-B components, ACARS components, ASDE-X components, etc.

Those skilled in the art will understand that the ADS-B components may provide accurate information and frequent updates to airspace users and controllers, and thus may support improved use of airspace, such as reduced ceiling/visibility restrictions, improved surface surveillance, and enhanced safety, for example through conflict management. An aircraft in communication with the ADS-B components may determine its own position using a global navigation satellite system and then periodically may broadcast this position and other relevant information to potential ground stations and other aircrafts within the system. The ADS-B components may be used over several different data link technologies, including Mode-S Extended Squitter ("1090 ES") operating at 1090 MHz, Universal Access Transceiver ("978 MHz UAT"), and VHF data link ("VDL Mode 4").

Those skilled in the art will understand that the ACARS components may be defined as a digital data-link system for the transmission of short messages between an aircraft and the ground stations via radio or satellite transmission. In addition, those skilled in the art will understand that the ASDE-X components may be defined as a runway-safety tool that enables air traffic controllers to detect potential runway conflicts through providing detailed coverage of vehicle/aircraft movement on runways, taxiways, etc. Specifically, by collecting data from a variety of sources, the ASDE-X components are able to track vehicles and aircraft on airport surfaces and obtain identification information from aircraft transponders.

According to the exemplary embodiments of the SMS module 100, the airport network information sources may include sources relaying airport field conditions, en route radar information, flight plan data, and operator data. Therefore, these airport information sources may allow the SMS module 100 to instantly identify aircraft information (e.g., tail number, owner, operator, aircraft registration and specification data) in order to create a detailed and accurate departure allocation grid including operator/aircraft profiles.

Figure 8:
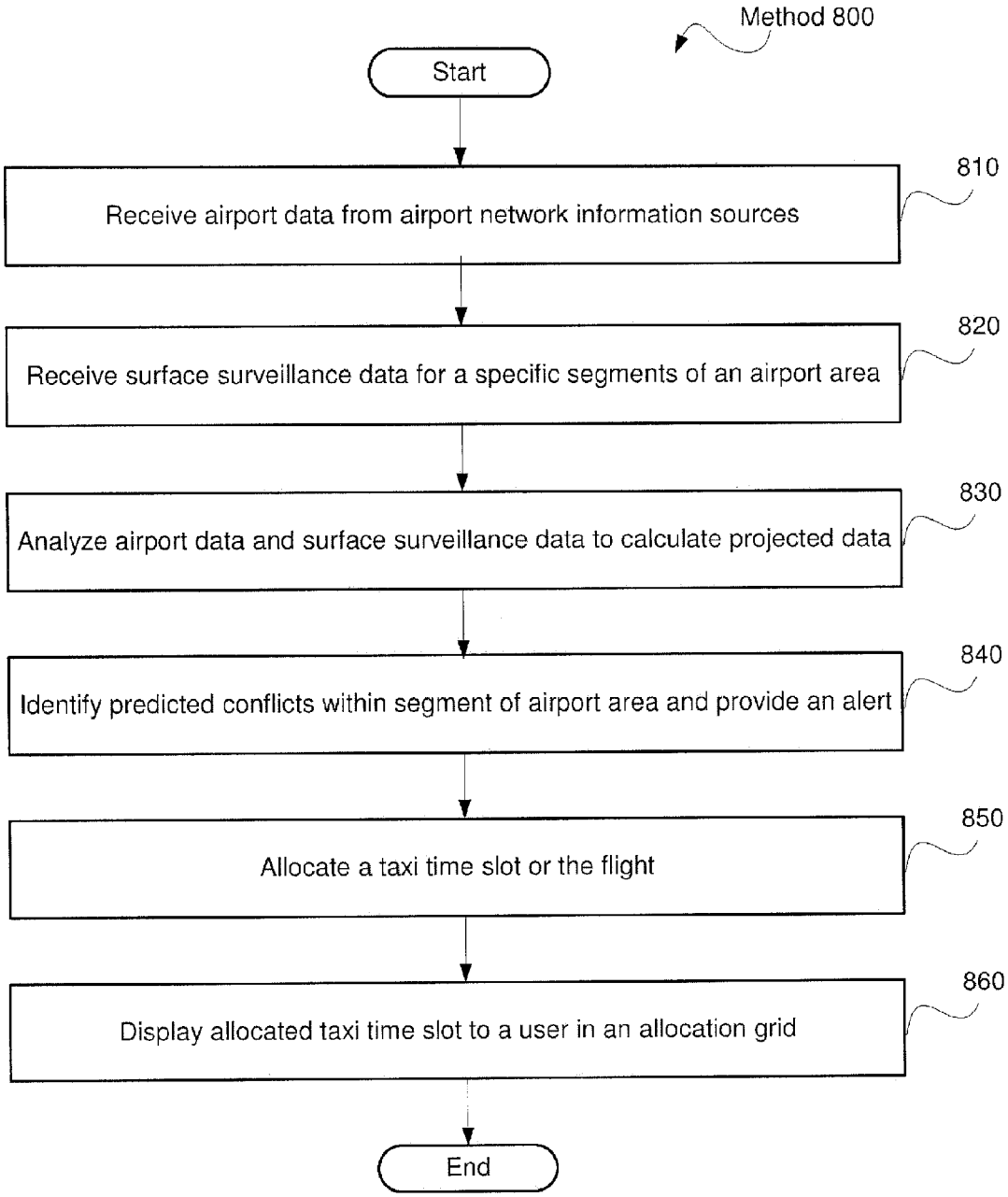
FIG. 8 shows a shows an exemplary method for surface management of an airport according to an exemplary embodiment of the present invention.

FIG. 8 shows an exemplary method 800 for surface management of an airport according to an exemplary embodiment of the present invention. It should be noted that the steps the exemplary method 800 may be performed by the various components of the system described in FIG. 1, such as the departure SMS module 100.

It should be noted that the exemplary SMS module 100 performing the steps of method 800 described herein may be incorporated into an existing system. As detailed above, the SMS module 100 may be a web-based communication system, such as a live allocation portal, in which a menu may be presented and an option may be available to access both historical flight information as well as currently tracked flight information. Accordingly, it should be noted that the steps of method 200 may be performed by a processor of a computer system (e.g., a departure allocation processor), wherein the steps are provide to the processor as a set of software instructions stored on a non-transitory computer-readable medium, such as a computer memory.

In step 810 of the method 800, the SMS module 100 may receive airport data from the airport network information sources. This information may include, but is not limited to, ETAs of specific inbound aircraft, status of arrival and departure fixes, status of runways, status of ground queues, forecasts of arrival and departure rates, airline departure demand by flight, sequencing (e.g., "virtual queuing") by fix, etc. Accordingly, this information may be used by the SMS module 100 to manage the departure slots.

In step 820 of the method 800, the SMS module 100 may receive surface surveillance data for specific segments (e.g., regions of interest) of an airport area. The SMS module 100 may coordinate with airport manager for each of the specific airport locations and runway assignments. The segments may include both FAA-classified movement areas, non-movement areas, airborne area, etc. In addition, this information may also include runway configurations and any taxiway closures that effect metering locations and/or access to metering locations. Furthermore, this information may include aircraft restrictions and suitability for each runway. For instance, specific runways and taxi routes may only be suitable for aircraft of a specific size or weight.

In step 830, the SMS module 100 may analyze the airport data and the surface surveillance data and calculate projected data. For instance, the SMS module 100 may utilize a dynamic predictive engine to provide real-time summaries and projections within each of the airport's segments. These summaries may include tables, timelines, key performance indicators, etc. Furthermore, the SMS module 100 may provide extensive pre-defined and ad-hoc post operational analysis and reports.

In step 840, the SMS module 100 may identify predicted conflicts within segment of airport area and provide one or more alerts to the user. The SMS module 100 may include a user-selected master alert metrics table for defining alert conditions and logic. Once a conflict is predicted or detected, the SMS module 100 may provide the user with an alert in the form of an on-screen message, an email, a text message, etc.

In step 850, the SMS module 100 may allocate a taxi time slot for the flight. Accordingly, an airline ramp tower may now advise the flight's pilot to request a departure taxi. Once the aircraft has been released and cleared of the metering location, the SMS module 100 may repeat the method 800 for a further aircraft, thereby assigning a metering location to this aircraft upon a request for metering.

In step 860, the SMS module 100 may display the allocated taxi time slot for the flight in an allocation grid via a user display/interface 110. According to one embodiment, the method 800 may provide instant communication to various outlets and terminals via a user interface (e.g., a web-enabled dashboard including an allocation portal). This web-enabled dashboard may allow the SMS module 100 to securely coordinate and collaborate with external entities such as specific airlines and governmental agencies (e.g., DEA operatives) in real-time.

Figure 9:
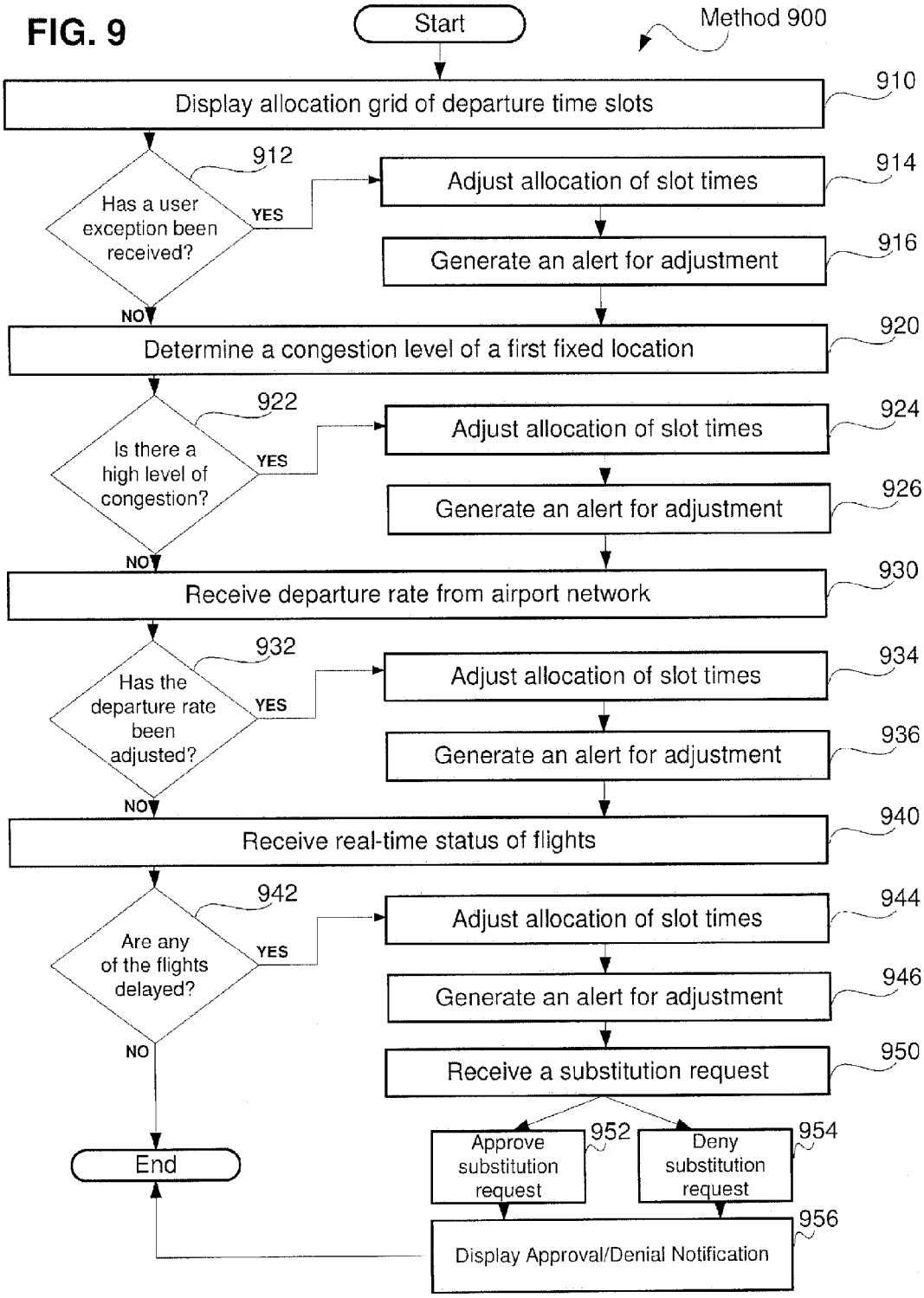
FIG. 9 shows an exemplary method 300 for determining and adjusting departure slot times during departure metering from an airport according to an exemplary embodiment of the present invention.

FIG. 9 shows an exemplary method 900 for determining and adjusting departure slot times using the SMS module 100 during departure metering from an airport according to an exemplary embodiment of the present invention. It should be noted that the steps of the exemplary method 900 may be performed by the various components described in FIG. 1, such as the SMS module 100. Furthermore, the exemplary method 900 may be performed at any time following the allocation of a specific flight's departure slot time.

In step 910 of the method 900, the SMS module 100 may display the allocation of departure slot times for a plurality of flights in an allocation grid.

In step 912, the SMS module 100 may determine whether a manual exception has been received from a user. If an exception is received for a specific flight, or group of flights, has been received, the SMS module 100 may adjust the departure slot times in step 914 and generate an alert to inform the user of the change in step 916. If an exception has not been received, the method 900 may advance to step 920.

In step 920 of the method 900, the SMS module 100 may determine a congestion level of a first fix location based on information provided by the airport network information sources. As noted above, the airport network information sources may include data entered manually by the user. Therefore, the determined congestion level may be based on user input.

In step 922, the SMS module 100 may determine whether the congestion level is above a predetermined threshold (e.g., a first fix location having a high level of congestion). If the congestion level is too high, the SMS module 100 may adjust the departure slot times in step 924 and generate an alert to inform the user of the change in step 926. If the congestion level is below the threshold, the method 900 may advance to step 930.

In step 930 of the method 900, the SMS module 100 may receive a departure rate from the airport network information sources.

In step 932, the SMS module 100 may determine whether the departure rate has been adjusted (e.g., the departure rate is reduced by 50% due to inclement weather). If the departure rate is adjusted, the SMS module 100 may adjust the departure slot times accordingly in step 934 and generate an alert to inform the user of the change in step 936. If the departure rate has not been adjusted, the method 900 may advance to step 940.

In step 940 of the method 900, the SMS module 100 may receive a real-time status update for the plurality of flights. Specifically, the SMS module 100 may receive radar data and current flight data (e.g., "live" flight data) from an integrated radar network, such as the airport network information sources 105 described in FIG. 1. As described above, an exemplary radar network may include a plurality of radar installations covering numerous domestic and international airports and terminal airspaces. The radar network may feature the ability to track any aircraft with a working transponder.

In step 942, the SMS module 100 may determine whether a specific flight will be delayed. If the departure of a flight will be delayed, the SMS module 100 may reallocate the departure slot times accordingly in step 944 and generate an alert to inform the user of the change in step 946. If there is no delay to the flight, the SMS module 100 may maintain the original allocation.

Furthermore, in step 950, the SMS module 100 may receive a swap request from an airline based on the delayed flight. The SMS module 100 may determine whether the swap request will be approved or denied. If approved, in step 952, the SMS module 100 may substitute the delayed flight with a further flight. If denied, in step 954, the SMS module 100 may reject the swap request. Furthermore, in step 956, the SMS module 100 may display either an approval message including substitution information or a denial message including denial description to the user via a user interface (e.g., a web-based dashboard).

It will be apparent to those skilled in the art that various modifications may be made in the present invention, without departing from the spirit or scope of the invention. Thus, it is intended that the present invention cover the modifications and variations of this invention provided they come within the scope of the appended claims and their equivalents.

What is claimed is:

1. A method, said method being executed by at least one processor, wherein the method comprises:

receiving airport data, the airport data including an aircraft-holding capacity value for each of a plurality of segments of an airport area, where the aircraft-holding capacity value is the threshold capacity for a number of aircraft permitted in each segment;

identifying predicted conflicts within a first one of the plurality of segments of the airport area;

identifying a predicted surface saturation level within the first segment based on the aircraft-holding capacity value for the first segment, wherein the predicted surface saturation level is a degree to which a forecast number of aircraft in the first segment matches the aircraft-holding capacity value; and allocating a taxi time slot for a flight in the first segment based on the predicted conflicts and the predicted surface saturation level.

2. The method of claim 1, further comprising:

generating an alert when a number of aircraft within the first segment equals the aircraft-holding capacity value for the first segment.

3. The method of claim 1, wherein the plurality of segments of the airport area includes one of a runway, gate, an alleyway entrance and a holding pad.

4. The method of claim 1, wherein the airport data includes a surface map color-coded based on the predicted saturation level.

5. The method of claim 1, wherein the predicted conflicts are identified based on an alert metrics table and a predictive logic engine, wherein the alert metrics table includes an alert condition.

6. The method of claim 1, wherein the airport data comprises one of runway configurations, taxiway availability, aircraft restrictions, aircraft suitability for specific runways, data received from automatic dependent surveillance-broadcast components, data received from aircraft communications addressing and reporting system components, and data received from airport surface detection equipment components.

7. The method of claim 1, further comprising:

determining an actual surface saturation level;

determining whether the actual surface saturation level is above a predetermined threshold; and adjusting the taxi time slot when the actual surface saturation level is above the predetermined threshold.

8. The method of claim 1, further comprising:

determining whether a departure rate for the airport area has been adjusted; and adjusting the taxi time slot when the departure rate has been adjusted.

9. The method of claim 1, further comprising:

determining whether a departure of the flight will be delayed; and adjusting the taxi time slot when the departure will be delayed.

10. The method of claim 1, further comprising:

receiving a swap request for the flight;

determining whether to approve the swap request; and swapping the taxi time slot with a further taxi time slot allocated to a further flight when the swap request is approved.

11. The method of claim 1, wherein the received airport data is secured using one of an encryption method, an authentication system, a verification system, and a security protocol.

12. A system, comprising:

a user interface displaying information related to airport data received from an airport network, the airport data including an aircraft-holding capacity value for each of a plurality of segments of an airport area, wherein the aircraft-holding capacity value is the threshold capacity for a number of aircraft permitted in each segment; and a surface management module receiving the airport data, identifying predicted conflicts within a first one of the plurality of segments of the airport area, identifying a predicted surface saturation level within the first segment based on the aircraft-holding capacity value for the first segment, wherein the predicted surface saturation level is a degree to which a forecast number of aircraft in the first segment matches the aircraft-holding capacity value, and allocating a taxi time slot for a flight in the first segment based on the predicted conflicts and the predicted surface saturation level.

13. The system of claim 12, wherein the airport data comprises one of runway configurations, taxiway availability, aircraft restrictions, aircraft suitability for specific runways, data received from automatic dependent surveillance-broadcast components, data received from aircraft communications addressing and reporting system components, and data received from airport surface detection equipment components.

14. The system of claim 12, wherein the surface management module further determines an actual surface saturation level, determines whether the actual surface saturation level is above a predetermined threshold, and adjusts the taxi time slot when the actual surface saturation level is above the predetermined threshold.

15. The system of claim 12, wherein the surface management module further determines whether a departure rate for the airport area has been adjusted and adjusts the taxi time slot when the departure rate has been adjusted.

16. The system of claim 12, wherein the surface management module further determines whether a departure of the flight will be delayed and adjusts the taxi time slot when the departure will be delayed.

17. The system of claim 12, wherein the surface management module further receives a swap request for the flight, determines whether to approve the swap request, and swaps the taxi time slot with a further taxi time slot allocated to a further flight when the swap request is approved.

18. The system of claim 12, wherein the received airport data is secured using one of an encryption method, an authentication system, a verification system, and a security protocol.

19. A non-transitory computer readable storage medium with an executable program stored thereon, wherein the program instructs a processor to perform the following steps:

receive airport data from an airport network, the airport data including an aircraft-holding capacity value for each of a plurality of segments of an airport area, wherein the aircraft-holding capacity value is the threshold capacity for a number of aircraft permitted in each segment;

identify predicted conflicts within a first one of the plurality of segments of the airport area;

identify a predicted surface saturation level within the first segment based on the aircraft-holding capacity value for the first segment, wherein the predicted surface saturation level is a degree to which a forecast number of aircraft in the first segment matches the aircraft-holding capacity value; and allocate a taxi time slot for a flight in the first segment based on the predicted conflicts and the predicted surface saturation level.

20. The non-transitory computer readable storage medium of claim 19, wherein the airport data comprises one of runway configurations, taxiway availability, aircraft restrictions, aircraft suitability for specific runways, data received from automatic dependent surveillance-broadcast components, data received from aircraft communications addressing and reporting system components, and data received from airport surface detection equipment components.

* * * * *